US006647551B2

(12) United States Patent
Palumbo

(10) Patent No.: US 6,647,551 B2
(45) Date of Patent: Nov. 18, 2003

(54) REVERSIBLE GARMENT

(75) Inventor: Victorio Palumbo, Milford, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/977,452

(22) Filed: Oct. 15, 2001

(65) Prior Publication Data

US 2003/0070206 A1 Apr. 17, 2003

(51) Int. Cl.[7] ..... A41D 1/06
(52) U.S. Cl. ..... 2/69; 2/227; 2/DIG. 2
(58) Field of Search ..... 2/227, 228, 238, 2/211, 247, 79, 69, 235, DIG. 2, 115, 108, 105, 106, 83, 80, 85, 93, 94, 95, 96

(56) References Cited

U.S. PATENT DOCUMENTS

| | | | | | |
|---|---|---|---|---|---|
| 1,337,698 | A | * | 4/1920 | Gongora | 2/237 |
| 2,233,567 | A | * | 3/1941 | Levinsohn | 2/227 |
| 2,763,011 | A | | 9/1956 | Gross | 2/106 |
| 3,234,564 | A | * | 2/1966 | Chujfi | 2/227 |
| 3,425,062 | A | * | 2/1969 | Chujfi | 2/227 |
| 3,495,274 | A | | 2/1970 | Isaacs | 2/96 |
| 4,481,683 | A | | 11/1984 | Estruch | 2/400 |
| 5,127,107 | A | | 7/1992 | Wood et al. | 2/84 |
| 5,204,995 | A | * | 4/1993 | Knapp | 2/228 |
| 5,561,860 | A | | 10/1996 | Nguyen-Senderowicz | 2/90 |
| D428,548 | S | | 7/2000 | Hosogai | |
| 6,128,783 | A | | 10/2000 | Blauer et al. | |
| 6,182,296 | B1 | | 2/2001 | Hosogai | |

* cited by examiner

*Primary Examiner*—Gloria M. Hale
(74) *Attorney, Agent, or Firm*—Vincent J. Ranucci

(57) ABSTRACT

A garment having two choices of pattern, color or fabric texture includes a top portion and a bottom portion. The top and bottom portions each includes a first side that is configured to have a first design and a second side that is opposite the first side and is configured to have a second design. The bottom portion has at least one pocket portion movably attached to the bottom portion and a corresponding pocket slot adjacent to the pocket portion. The top portion has first and second front edge parts that are removably secured together in an overlapping relationship when the top portion is in a closed configuration.

13 Claims, 10 Drawing Sheets

REVERSIBLE GARMENT

The invention described herein may be manufactured and used by the U.S. Government for Governmental purposes without the payment of any royalty thereon.

BACKGROUND OF THE INVENTION

1. Field of the Invention

The present invention generally relates to a reversible garment.

2. Description of Related Art

Reversible clothing is known in the art. U.S. Pat. Nos. 6,128,783, 6,182,296, 5,204,995, 5,561,860, Des. 428,548, 4,481,683, 3,495,274 and 2,763,011 all disclose various types of reversible garments. Reversible garments are designed such that the two surfaces of the garment have a different pattern, color, or texture. Therefore, the user is provided with two choices of pattern, color or fabric texture with each garment.

Some types of reversible garments are constructed using two different types of fabrics. The two fabrics are sewn together such that a different fabric faces outward when the garment is turned inside out and vice versa. Other reversible garments have been designed using a two-sided, single fabric. One problem commonly found in reversible pants concerns the difficulty in using belts or other fastening devices to secure the pants to the wearer. Belts, buttons or zippers that are accessible from one side of the garment must be just as easily accessible when the pants are reversed. Similarly, pockets used in the pants must be easily accessible when either side of the fabric is outward facing. Furthermore, the pockets of the reversible garment must not cause or increase any bulkiness in dual fabric configurations.

What is needed is an improved reversible garment that addresses the aforementioned problems and provides the aforementioned desirable features.

SUMMARY OF THE INVENTION

The present invention is directed to, in one aspect, a reversible garment that comprises a top portion for covering at least the upper torso and shoulder portions of a body of a wearer. The top portion has an interior side confronting the wearer's body and an exterior side opposite the interior side. The top portion has a first side configured to have a first design and a second side opposite the first side and configured to have a second design. The top portion is reversible to a first configuration wherein the first side defines the exterior side and the second side defines the interior side and to a second configuration wherein the second side defines the exterior side and the first side defines the interior side. The top portion has first and second front edge portions that are removably secured together in an overlapping relationship when the top portion is in a closed configuration. The reversible garment of the present invention further comprises a bottom portion for covering at least the waist portion and a portion of the thighs of the wearer's body. The bottom portion has an interior side confronting the wearer's body and an exterior side opposite the interior side. The bottom portion further includes a waist portion, a first side that is configured to have the first design and a second side that is opposite the first side and is configured to have the second design. The bottom portion is reversible to either a first configuration wherein the first side of the bottom portion defines the exterior side of the bottom portion and the second side of the bottom portion defines the interior side of the bottom portion, or a second configuration wherein the first side of the bottom portion defines the interior side of the bottom portion and the second side of the bottom portion defines the exterior side. The bottom portion further includes at least one pocket portion movably attached to the bottom portion and a corresponding pocket slot adjacent to and sized for receiving the pocket portion. The pocket portion has a first pouch and a second pouch. The first pouch has an exterior side configured to have the first design. The second pouch has an exterior side that is configured to have the second design. When the wearer desires to wear the garment so that the first design is visible and the second design faces the wearer's body, the wearer configures the top and bottom portions to the first configuration and inserts the pocket portion through the pocket slot so that the exterior side of the first pouch is visible and the exterior side of the second pouch faces the wearer's body. When the wearer desires to wear the garment so that the second design is visible and the second design faces the wearer's body, the wearer configures the top and bottom portions to the second configuration and inserts the pocket portion through the pocket slot so that the exterior side of the second pouch is visible and the exterior side of the first pouch faces the wearer's body.

The bottom portion further includes a pouch formed in and extending about the waist portion. The pouch is sized for receiving a belt having a pair of ends. The pouch has a pair of openings formed therein and located on the second side of the bottom portion so as to allow the belt ends to extend from the openings when a belt is disposed within the pouch. The waist portion further includes a pair of slots formed therein. Each slot is sized so as to allow a corresponding end of the belt to pass therethrough. When a belt is disposed in the pouch, the wearer inserts each end of the belt through a corresponding slot so that the ends of the belt are positioned on the first side of the bottom portion when the wearer configures the bottom portion in first configuration. When the wearer configures the bottom portion in the second configuration, the wearer withdraws the ends of the belt from the slots so that the ends off the belt are positioned on the second side of the bottom portion.

The belt includes a fastening device, such a buckle, having complementary fastening portions. Each complementary fastening portion is attached to a corresponding end of the belt. Each slot is sized so as to allow a corresponding complementary fastening portion to pass therethrough.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE INVENTION

In the ensuing description, reference is made to FIGS. 1–4*a*. It is to be understood that these Figures are shown for illustrative purposes and are not drawn to scale and are not to be interpreted as limiting the scope of the present invention.

The present invention is directed to a reversible garment. However, the ensuing description is in terms of that reversible garment being a military battle dress uniform ("BDU") comprising top portion 10 shown in FIGS. 1 and 2, and bottom portion 70 shown in FIG. 3. Although the ensuing description is in terms of a garment for military use, it is to be understood that the present invention, and the underlying concepts thereof, can be applied to fabricating reversible clothing and garments for civilian use and in particular, civilian clothing and garments for men, women, and children. Examples of such civilian clothing include clothing for hunting, fishing and other outdoor sports.

Figure 1:
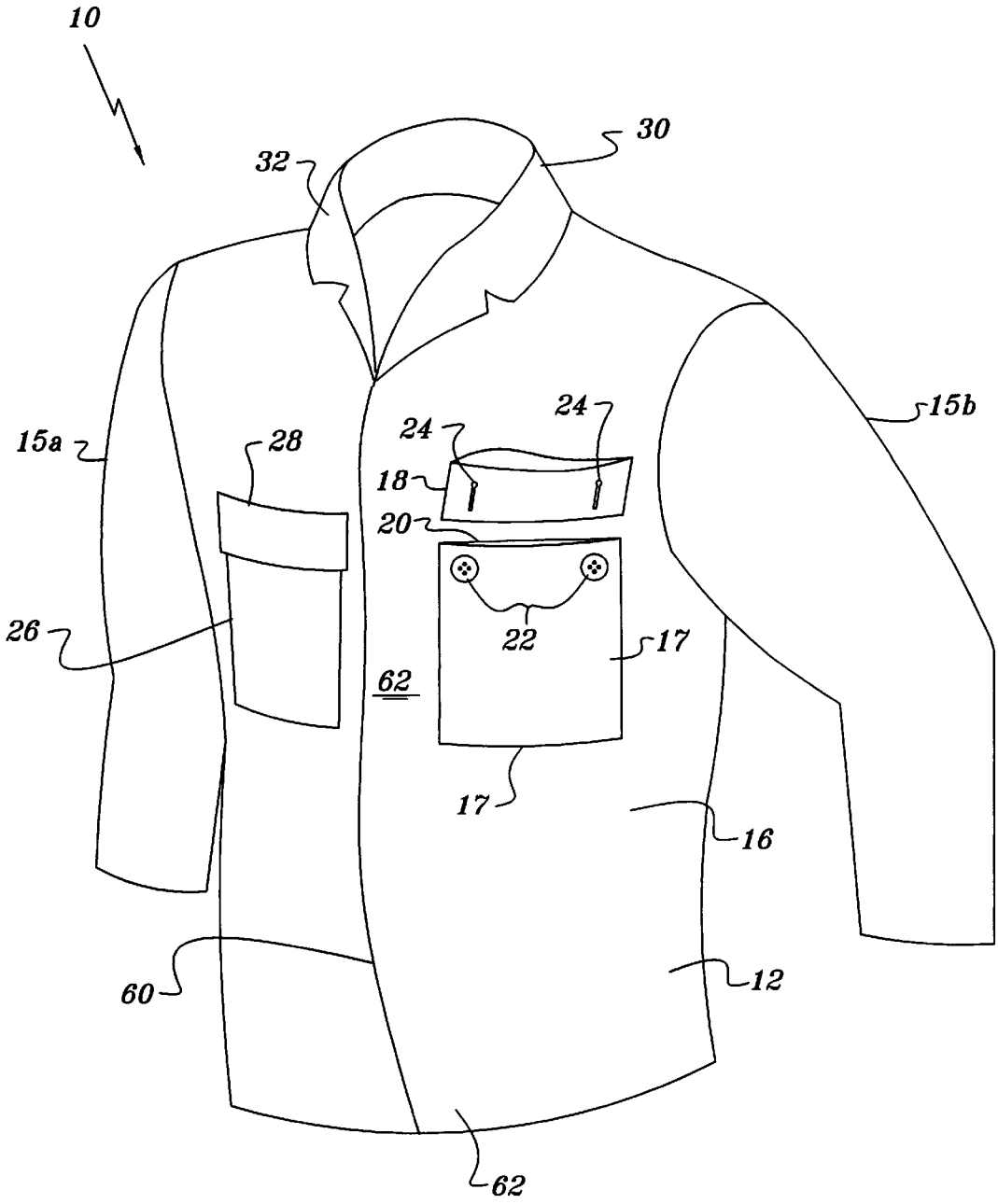
FIG. 1 is a perspective view of a top portion of the reversible garment of the present invention, the top portion being configured to show a first design.
Figure 2:
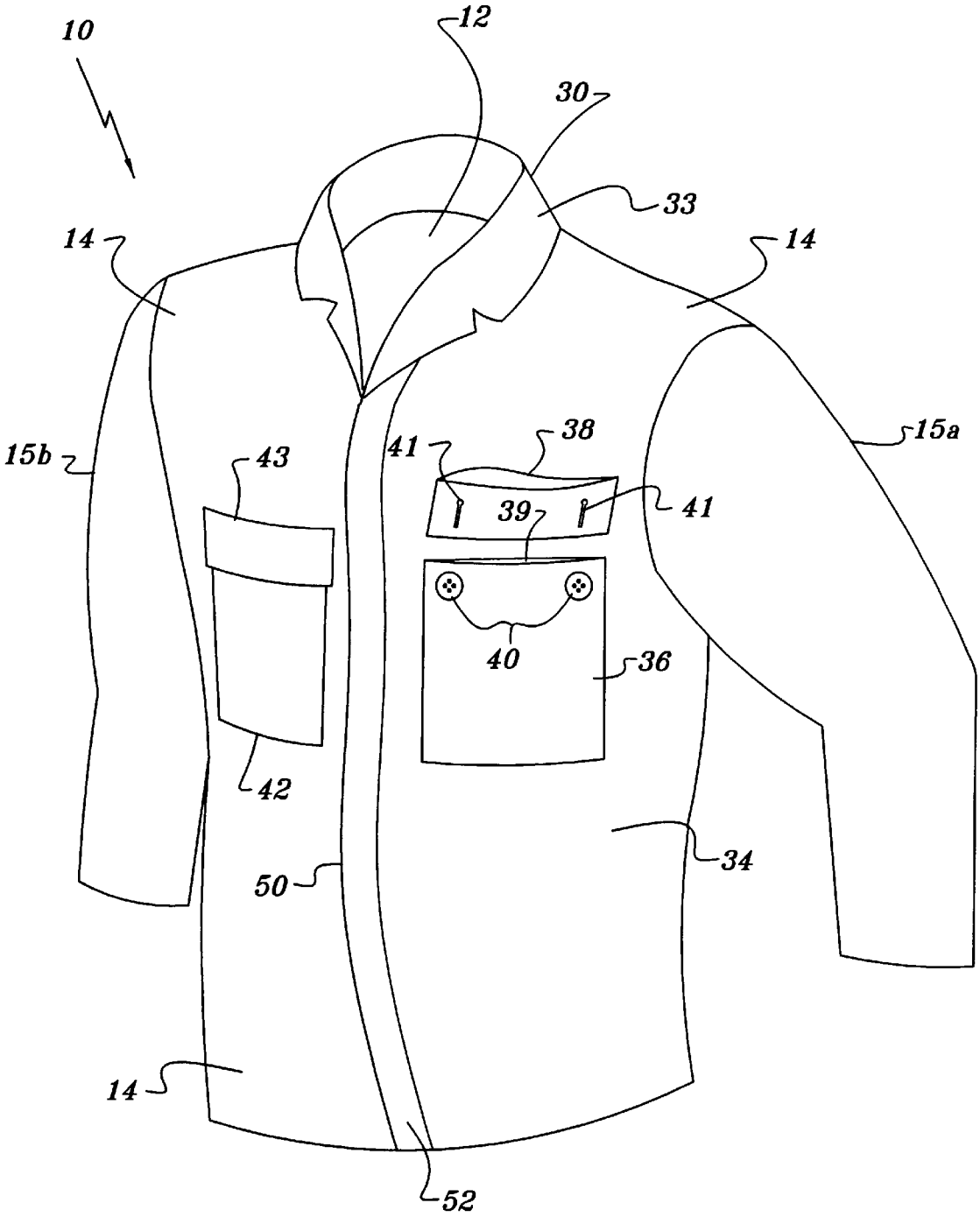
FIG. 2 is a perspective view of the top portion of the reversible garment of the present invention, the top portion being configured to show a second design.
Figure 2A:
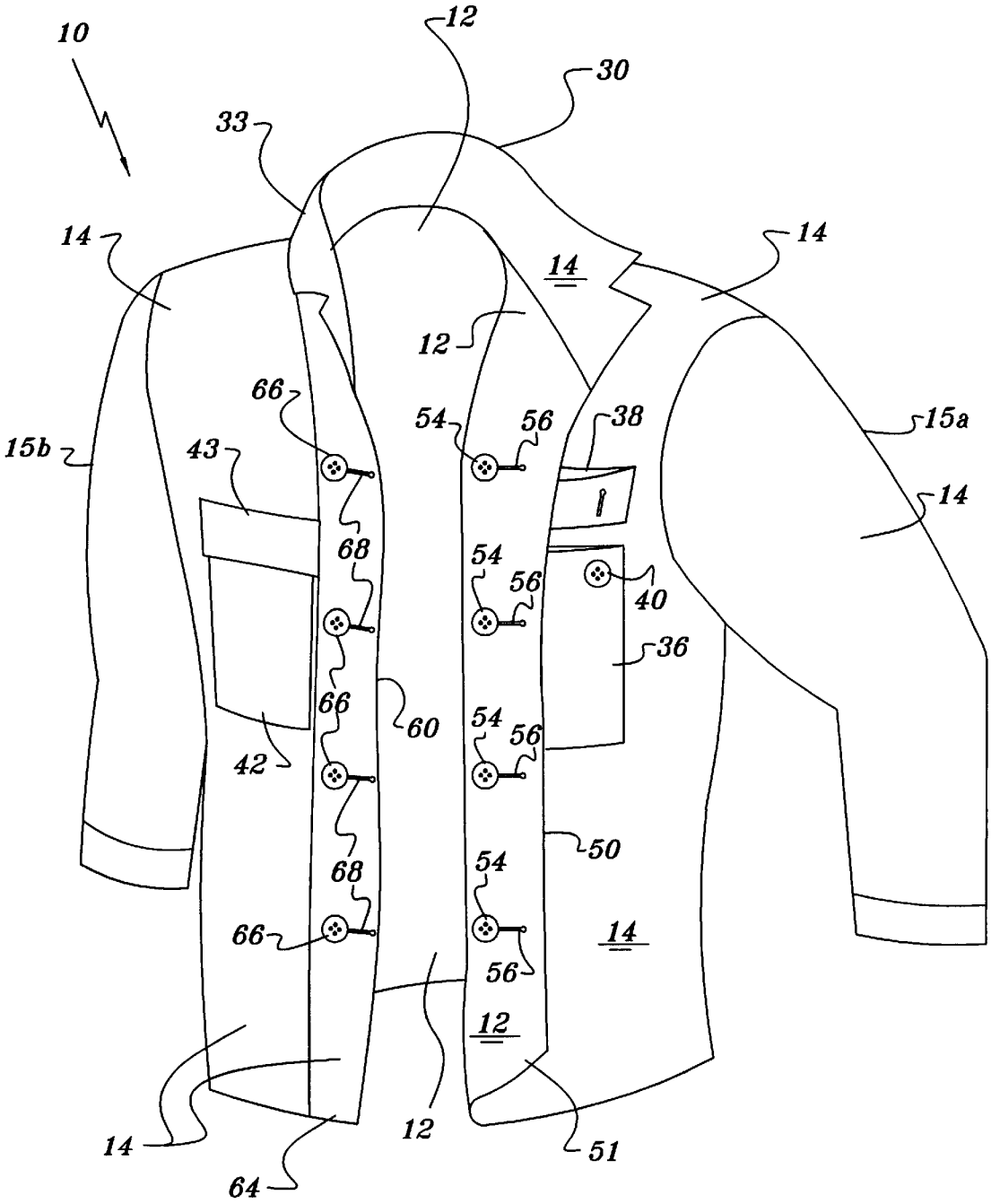
FIG. 2*a* is a perspective view of the top portion of FIG. 2 in an opened configuration.

Referring to FIGS. 1 and 2, there is shown reversible top portion 10 of the present invention. Top portion 10 can be configured as a shirt or jacket or any other type of garment that can be used to cover at least a portion of the torso and upper portion (i.e. shoulder, chest, etc.) of a wearer's body. Top portion 10 is fabricated from a conventional fabric such as Dacron, Nylon, Polyester, cotton or combinations thereof. Top portion 10 includes side 12 and side 14. Side 14 is directly opposite side 12. Side 12 has thereon a first type of printed design or printed pattern. Side 14 has thereon a second type of printed design or printed pattern that is different than the first design or pattern that is on side 12. When top portion 10 is configured as shown in FIG. 1, side 12 functions as the exterior side of top portion 10, and side 14 functions as the interior side of top portion 10. Thus, when top portion 10 is configured as shown in FIG. 1, the design or printed pattern of side 14 is not visible. When top portion 10 is configured as shown in FIGS. 2 and 2A, side 12 functions as the interior side of top portion 10, and side 14 functions as the exterior side of top portion 10. Thus, when top portion 10 is configured as shown in FIGS. 2 and 2*a*, the design or printed pattern of side 12 is not visible. If top portion 10 is currently configured as shown in FIG. 1 and a user desires the configuration shown in FIGS. 2 and 2*a*, the user simply turns top portion 10 inside out. Likewise, if top portion 10 is currently configured as shown in FIGS. 2 and 2*a* and a user desires the configuration shown in FIG. 1, the user simply turns top portion 10 inside out.

Top portion 10 includes symmetrical arm portions 15*a* and 15*b*. Top portion 10 further includes front portion 16 and active, exterior, front pocket pouch 17. In one embodiment, pouch 17 is formed by directly sewing, or otherwise attaching, a piece or fabric or other material to front portion 16. Flap 18 is sewn or otherwise attached to front portion 16 and covers opening 20 of pocket pouch 17 and is secured by buttons 22 which can be removably inserted into button holes 24 in flap 18. Top portion 10 further includes a portion of material that is directly sewn or otherwise attached to front portion panel 16 to form a simulated pocket pouch 26. Simulated pocket pouch 26 includes simulated pocket flap 28.

Figure 1A:
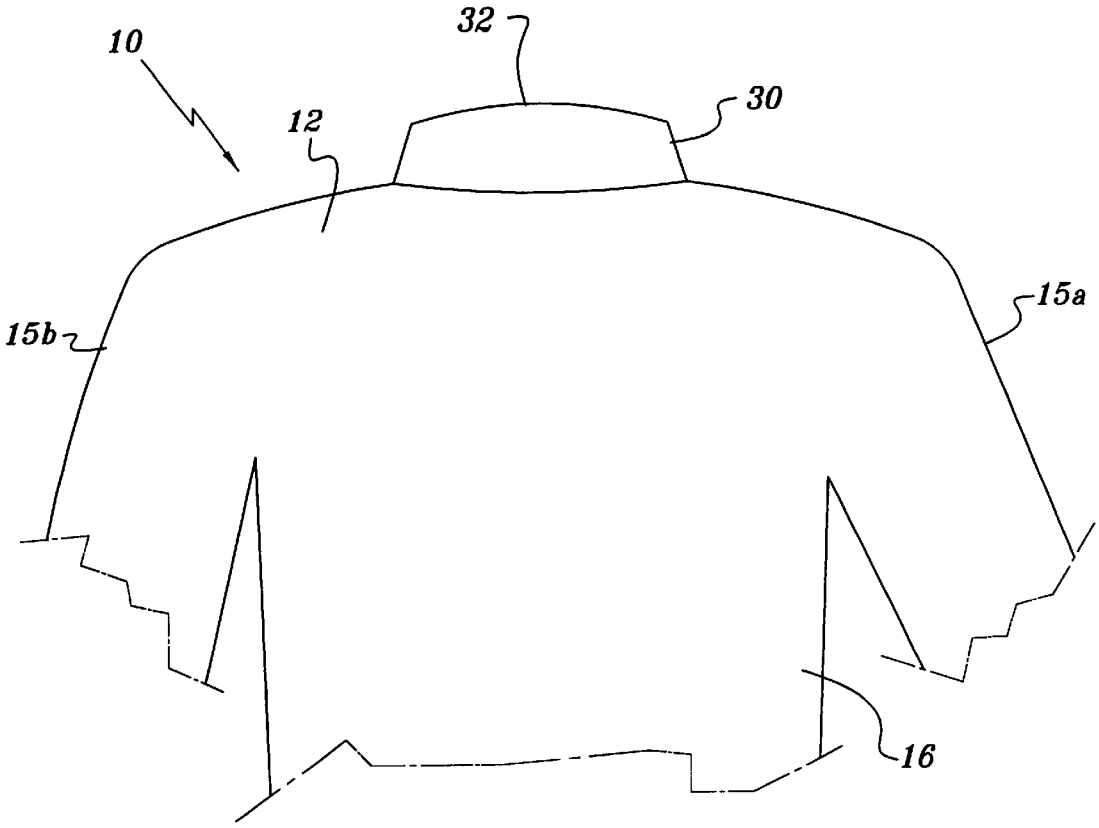
FIG. 1*a* is a rear view of a portion of the top portion shown in FIG. 1.
Figure 1B:
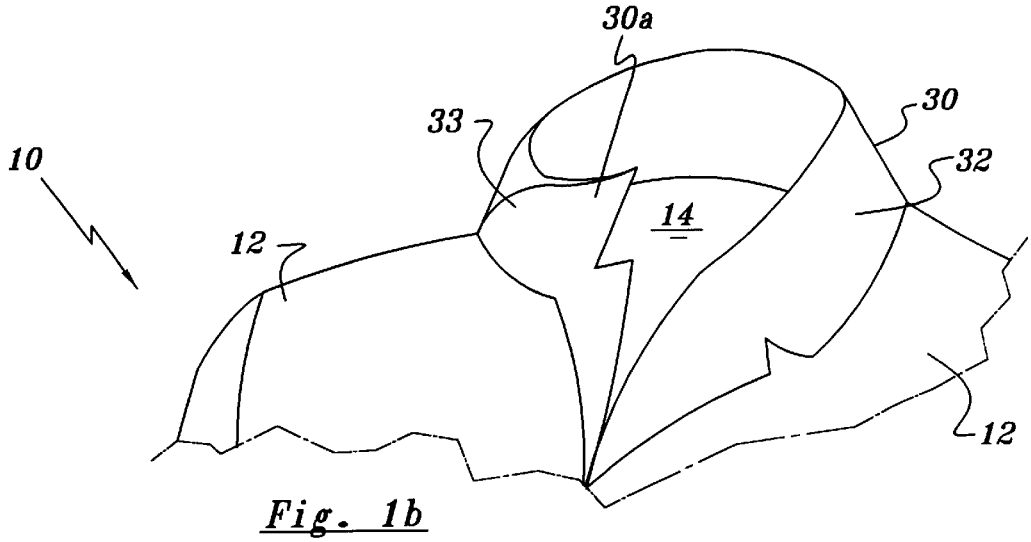
FIG. 1*b* is a front view, in perspective, of an upper portion of the top portion of FIG. 1.

Referring to FIGS. 1, 1*a* and 1*b*, top portion 10 further includes collar 30. Collar 30 has side 32 that has thereon a design or pattern that conforms to or matches the design or pattern on side 12. FIG. 1*b* shows portion 30*a* of collar 30 being turned upward so it can be seen that collar 30 further includes side 33 that has thereon a design or pattern that matches the design or pattern on side 14. When side 12 of top portion 10 functions as the exterior side, collar 30 is positioned as shown in FIGS. 1, 1*a* and 1*b* wherein side 32 functions as the exterior side of collar 30. When side 14 of top portion 10 functions as the exterior side, collar 30 is positioned as shown in FIG. 2 and 2*a* wherein side 33 functions as an exterior side of collar 30. A user need only flip the collar 30 over after he or she turns top portion 10 inside out so that the design of collar 30 will match or conform to the design of the selected side of top portion 10 (i.e. side 12 or 14) that functions as the exterior side of top portion 10.

Referring now to FIGS. 2 and 2*a*, side 14 of top portion 10 includes front portion 34 and an exterior, front pocket pouch 36 attached to front portion 34. Pocket pouch 36 is sewn directly onto side 14 directly opposite simulated pocket 26 that is located on side 12 of top portion 10. Flap 38 is movably attached to side 14 and covers opening 39 of pocket 36. Flap 38 is secured to pocket pouch 36 by buttons 40 that are inserted into button holes 41. Similarly, side 14 further includes simulated pocket 42 that is sewn directly onto the side 14 and is directly opposite pocket pouch 17 that is located on side 12 of top portion 10. Simulated pocket 42 includes simulated pocket flap 43.

Figure 1C:
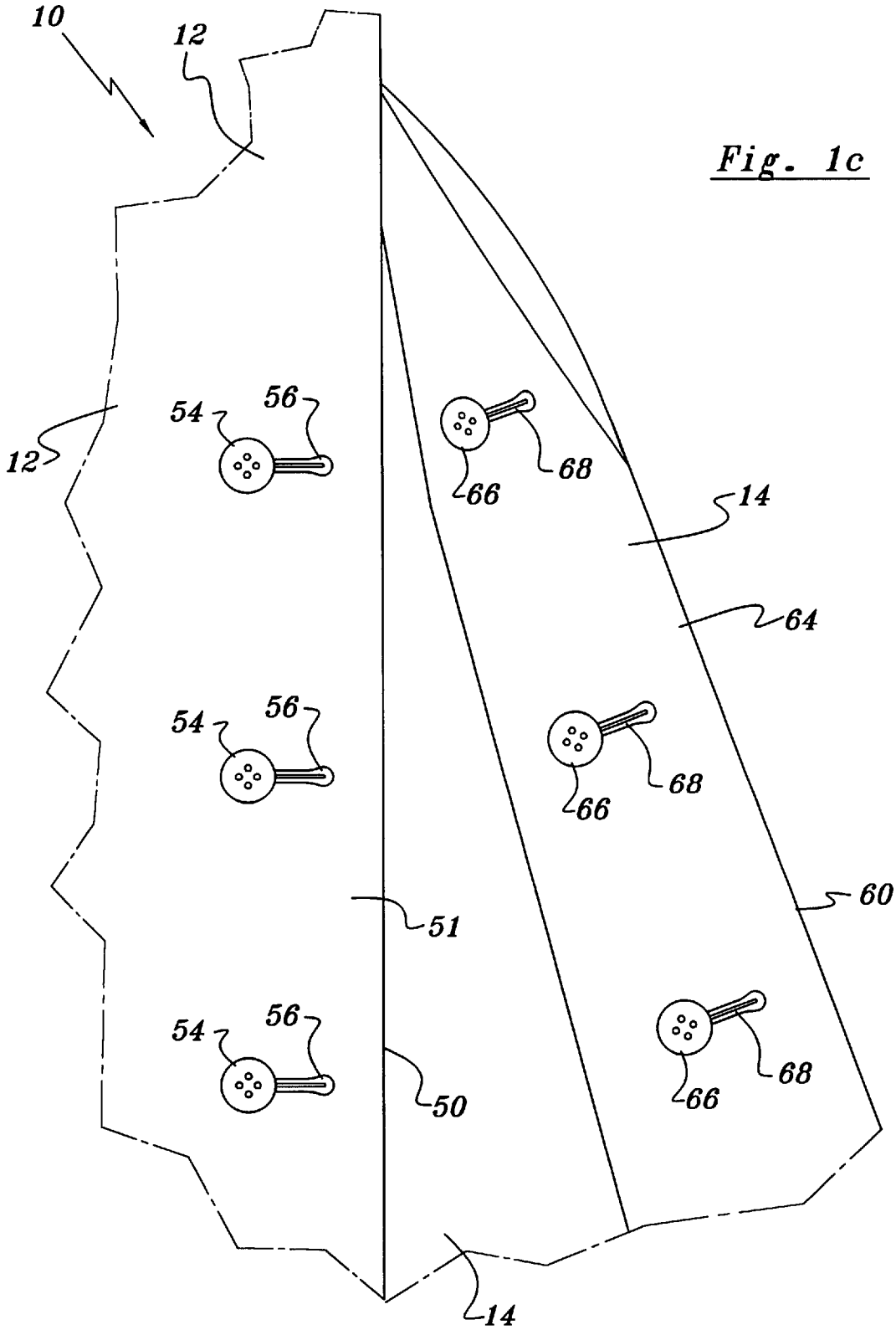
FIG. 1*c* is a partial view of the front side of the top portion of FIG. 1 wherein the top portion is partially opened.
Figure 1D:
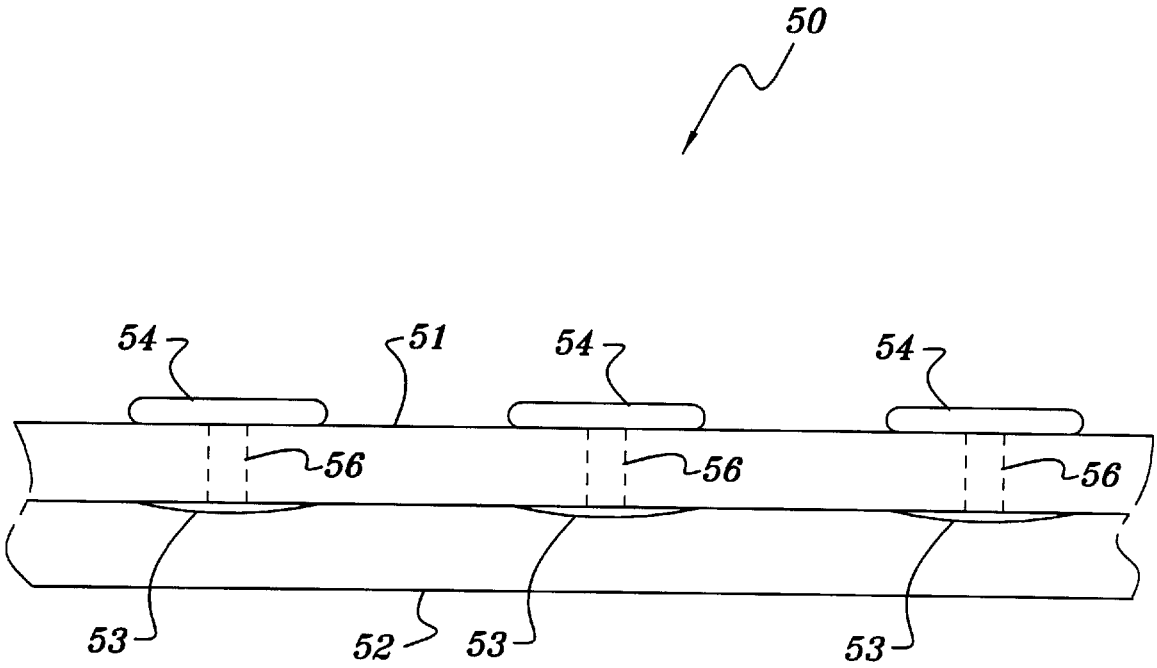
FIG. 1*d* is a side-elevational view showing the construction of a front edge portion shown in FIG. 1*c*.

Referring to FIGS. 1*c* and 1*d*, top portion 10 includes edge portion 50 that comprises portion 51 of side 12 and strip 52 (see FIG. 2) that is located on side 14 and is directly behind portion 51. Strip 52 is sewn to the rear of portion 51. Strip 52 is shown in FIG. 2 which illustrates top portion 10 in a second configuration wherein side 14 defines the exterior side of top portion 10. Strip 52 is configured to have thereon a design or pattern that is the same as the design or pattern on side 14. Strip 52 is sewn in such a manner so as to create spaces 53 (see FIG. 1*d*) between portion 51 and strip 52. Edge portion 50 includes buttons 54 attached to portion 51 and button slots or holes 56 formed in portion 51. Button slots or holes 56 are adjacent to buttons 54 and are generally horizontally oriented.

Referring to FIGS. 1 and 1*c*, top portion 10 further includes edge portion 60 that comprises portion 62 of side 12 and strip 64 (see FIG. 2*a*) that is located on side 14 and is directly behind portion 62. Strip 64 is sewn to the rear side of portion 62. Strip 64 is configured to have thereon a design or pattern that is the same as the design or pattern on side 14. Strip 64 is sewn in such a manner so as to create spaces (not shown but similar to spaces 53 shown in FIG. 1*d*) between portion 62 and strip 64. Strip 64 includes buttons 66 and button slots or holes 68. Button slots or holes 68 are adjacent to buttons 66 and are generally horizontally oriented.

When top portion 10 is in the first configuration and closed as shown in FIG. 1, edge portion 60 overlaps edge portion 50 in such a manner that strip 64 confronts, contacts and covers portion 51. In order to removably secure edge portions 50 and 60 together, the wearer inserts buttons 54 into button holes or slots 68. Buttons 54 are positioned within the space between portion 62 and strip 64 and do not contact the body of the wearer. Referring to FIG. 2, there is shown top portion 10 closed and in a second configuration wherein side 14 is the exterior side of top portion 10. In such a configuration, strip 52 is exposed and visible and portion 51 confronts and covers strip 64 (see FIG. 2*a*). In order to removably secure edge portions 50 and 60 together, the wearer inserts buttons 66 into button holes or slots 56. Buttons 66 are positioned within space 53 (see FIG. 1*d*) and do not contact the body of the wearer.

Figure 3:
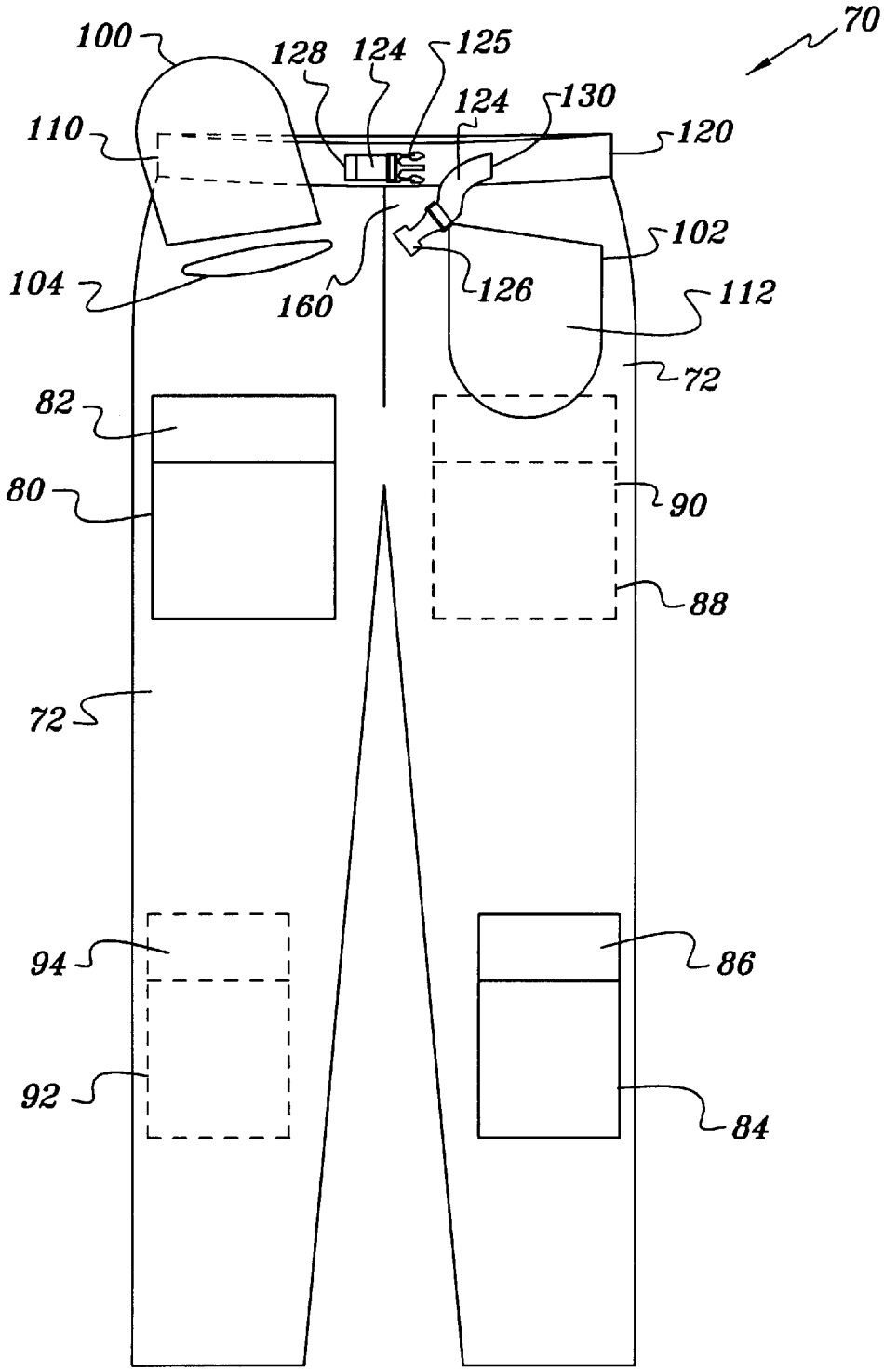
FIG. 3 is a front elevational view of a bottom portion of the garment of the present invention, the bottom portion being configured to show the first design.
Figure 3A:
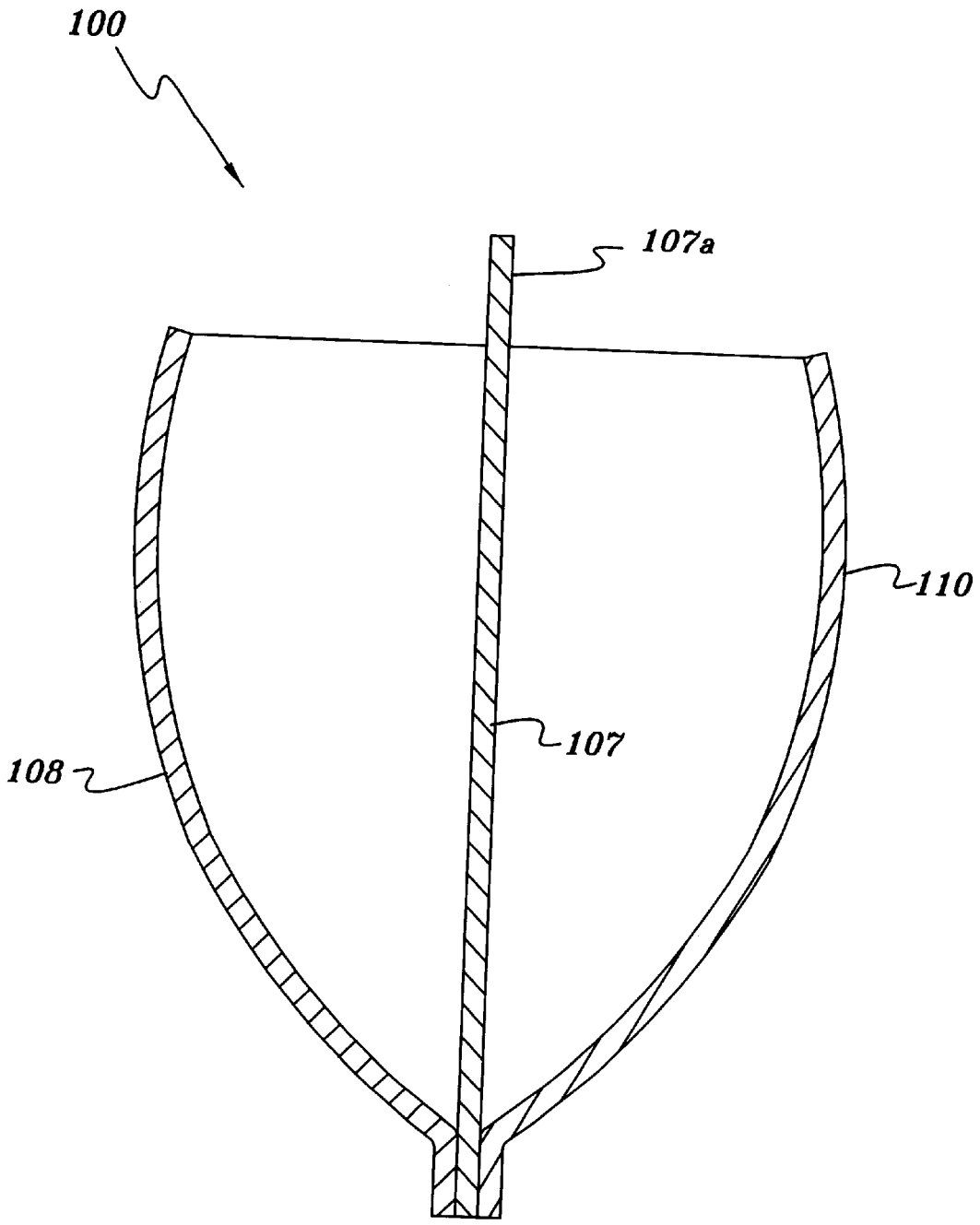
FIG. 3*a* is a side elevational view, in cross-section, that illustrates the structure of a pocket pouch depicted in FIG. 3.
Figure 4:
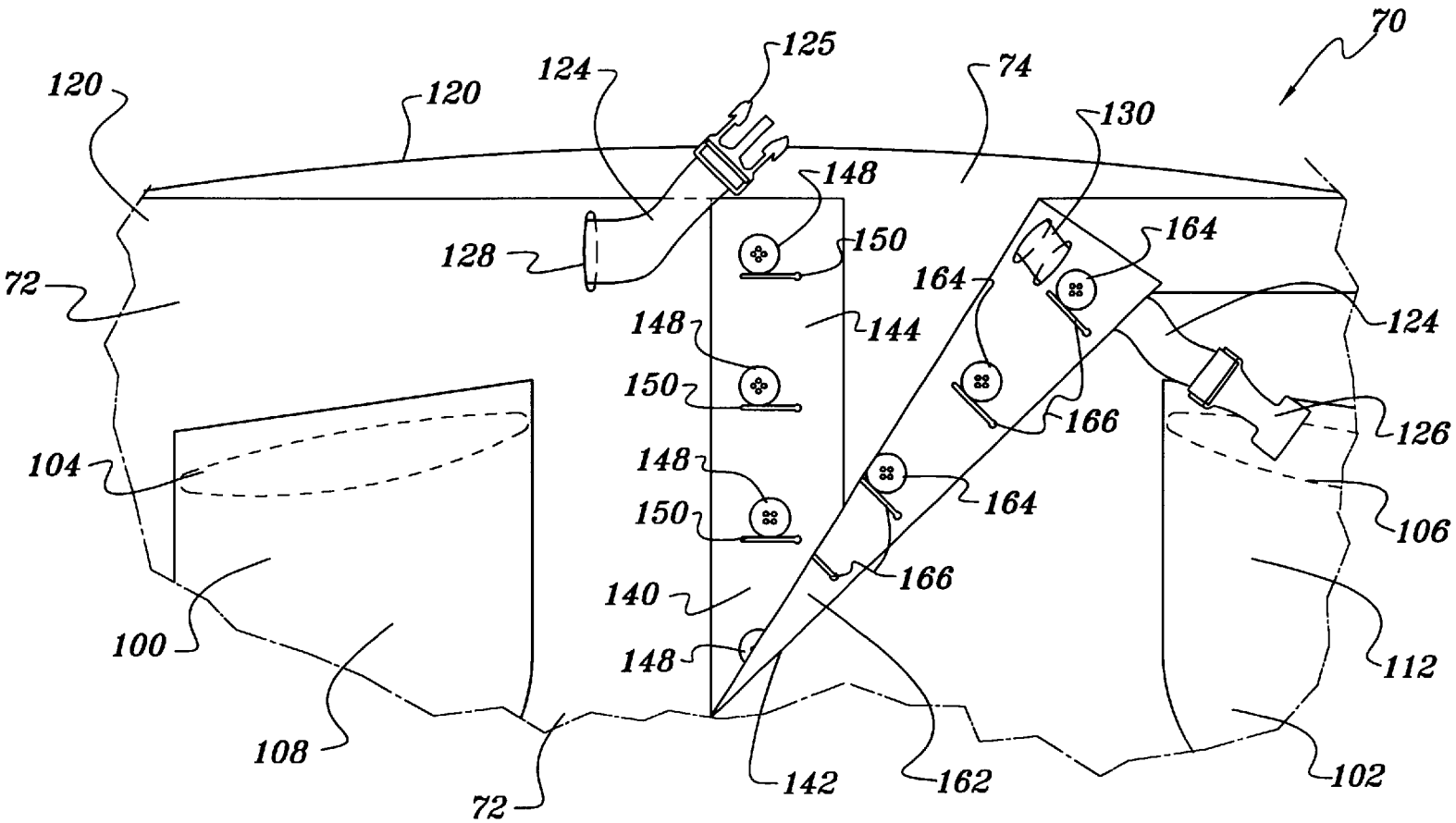
FIG. 4 is an enlarged view of a portion of the bottom portion of FIG. 3.
Figure 4A:
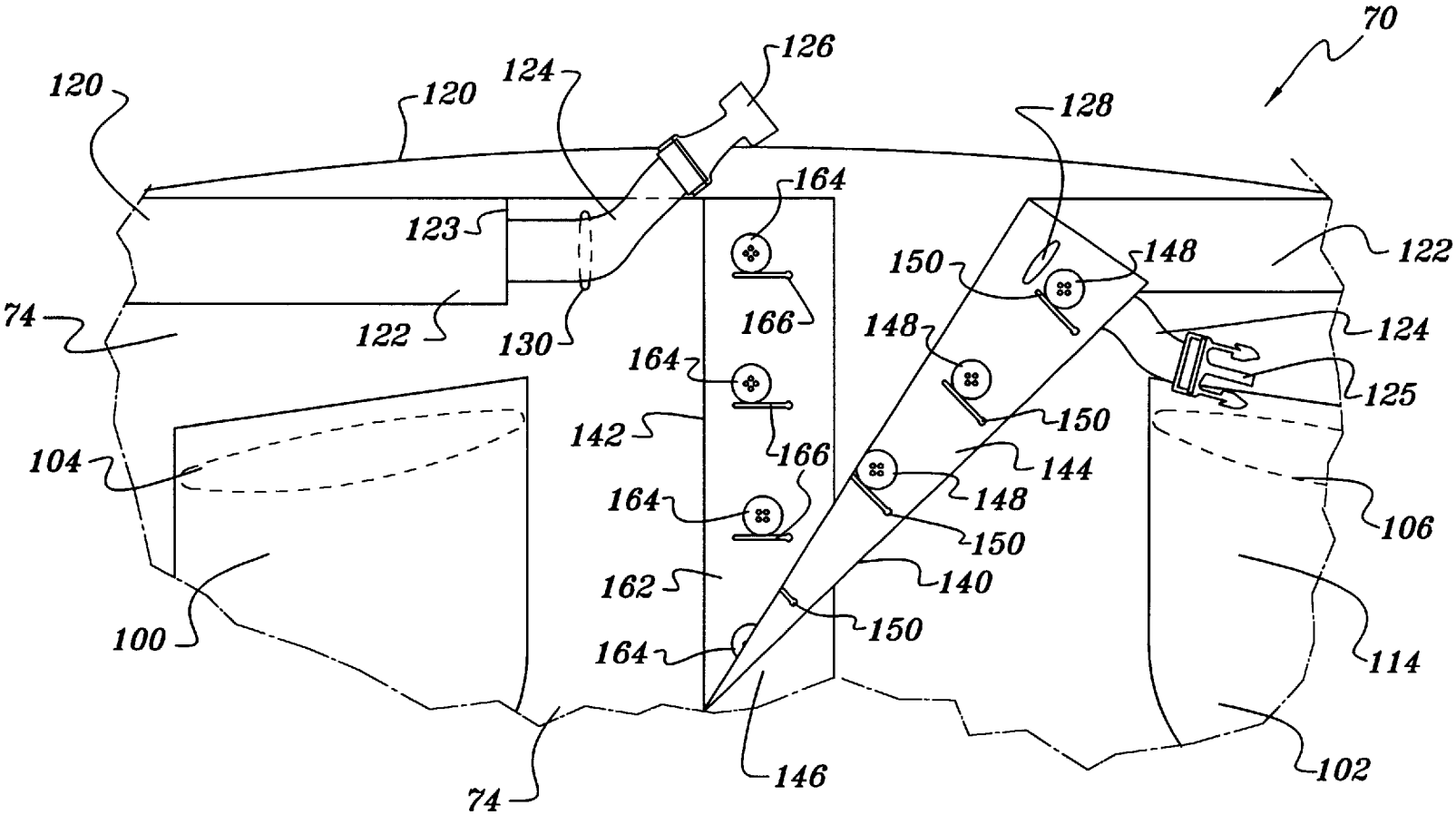
FIG. 4*a* is a view, similar to FIG. 4, of the bottom portion of the garment of the present invention, the bottom portion being configured to show the second design.

Referring to FIGS. 3, 4 and 4*a*, there is shown bottom portion 70 of the reversible garment of the present invention. It is to be understood that bottom portion 70 can be configured as pants, slacks, shorts, etc. Bottom portion 70 comprises first side 72 and a second side 74 directly opposite the first side 72. First side 72 is configured to have thereon the same design or printed pattern that is on side 12. Second side 74 is configured to have thereon the same design or printed pattern that is on side 14. Thus, bottom portion 70 can be turned inside out so that either side 72 is the exterior side and side 74 is the interior side, or side 74 is the exterior side and side 72 is the interior side.

Referring to FIG. 3, bottom portion 70 further includes pocket pouch 80 that is sewn directly to side 72. Flap 82 is movable attached to side 72 and covers the opening (not shown) of pocket pouch 80. Bottom portion 70 further includes pocket pouch 84 that is sewn directly to side 12 of bottom portion 70. Flap 86 is movably attached to side 72 and covers the opening (not shown) of pocket pouch 84. Bottom portion 70 further includes pocket pouch 88 that is sewn directly to side 74 of bottom portion 70 and is therefore shown in phantom in FIG. 3. Flap 90 is movably attached to side 74 and covers the opening (not shown) of pocket pouch 88. Bottom portion 70 further includes pocket pouch 92 that is sewn directly to side 74 and is therefore shown in phantom in FIG. 3. Flap 94 is movably attached to side 74 and covers the opening (not shown) of pocket pouch 92. Although four pockets pouches 80, 84, 88, and 92 with corresponding flaps are shown, bottom portion 70 may have more than or less than four such pockets pouches. Buttons (not shown) that are attached to pocket pouches 80, 84, 88 and 92 and corresponding button holes (not shown) formed in corresponding flaps 82, 86, 90 and 94, respectively, are used to removable secure these flaps to the aforementioned pocket pouches.

Referring to FIGS. 3, 3*a*, 4 and 4*a*, bottom portion 70 further includes pocket pouches 100 and 102 that are movable attached to side 72 bottom portion 70. Bottom portion 70 further comprises pocket pouch slots 104 and 106 (slot 106 is shown in phantom in FIGS. 4 and 4*a*) that are adjacent to pocket pouches 100 and 102, respectively. Each pocket pouch 100 and 102 is located just above pocket slots 104 and 106, respectively. Pocket slots 104 and 106 are sized to allow pocket pouches 100 and 102, respectively, to pass therethrough. Pocket pouch 100 comprises intermediate portion 107. Portion 107 includes portion 107*a* that is attached to side 72. Pocket pouch 100 further includes first side 108 that has thereon the same design or pattern that is on side 12. Pocket pouch 100 further includes second side 110 that has thereon the same design or printed pattern that is on side 14. Similarly, pocket pouch 102 comprises an intermediate member which is not shown, but which has the same structure and function as portion 107. Pocket pouch 102 further comprises first side 112 that has thereon the same design or printed pattern that is on side 12. Pocket pouch 102 further includes second side 114 that has thereon the same design or printed pattern that is on side 14. Once the wearer configures bottom portion 70 so that side 72 defines the exterior side of bottom portion and side 74 defines the interior side, such as shown in FIGS. 3 and 4, the wearer then inserts pocket pouches 100 and 102 through pocket slots 104 and 106, respectively. As a result, sides 108 and 112 of pouches 100 and 102, respectively, face outward and are visible, and sides 110 and 114 confront or face the wearer and are not visible. Conversely, once the wearer configures bottom portion 70 so that side 74 defines the exterior side of bottom portion and side 72 defines the interior side, such as shown in FIG. 4*a*, the wearer then inserts pocket pouches 100 and 102 through pocket slots 104 and 106, respectively. As a result, sides 110 and 114 of pouches 100 and 102, respectively, face outward and are visible, and sides 108 and 112 confront or face the wearer and are not visible.

Referring to FIGS. 3, 4, and 4*a*, bottom portion 70 further includes waist portion 120 and pouch 122 that is located on side 74 and extends about waist portion 120. In one embodiment, pouch 122 is formed with a strip of material that is sewn or otherwise attached to side 74. Pouch 122 is sized for receiving belt 124 which is movably disposed within pouch 122. Pouch 122 includes a pair of openings, one of which indicated by the numeral 123 while the other one is not shown, through which the ends of belt 124 extend. Belt 124 includes complementary fastening portions 125 and 126 attached to the ends of belt 124. Bottom portion 70 further includes slots 128 and 130 (shown in phantom) that are sized so as to allow fastening portions 125 and 126, respectively, to pass therethrough.

Referring to FIGS. 3 and 4, if bottom portion 70 is configured so that side 72 defines the exterior side of bottom portion 70 and side 74 defines the interior side, then pouch 122 is on the interior and confronts and contacts the users body. The wearer then passes fastening portions 125 and 126 through slots 128 and 130, respectively, so that fastening portions 125 and 126 are located on side 72.

Referring to FIGS. 4 and 4*a*, if bottom portion 70 is then turned inside out so that side 74 defines the exterior side of bottom portion 70 and side 72 defines the interior side, then pouch 122 is on the exterior and faces outward or away from the wearer. The wearer then withdraws fastening portions 125 and 126 from slots 128 and 130, respectively, so that fastening portions 125 and 126 are located on side 74 as shown in FIG. 4*a*. As shown in FIG. 4*a*, the positions of fastening portions 125 and 126, with respect to the wearer's right and left side, are reversed to the position of fastening portions 125 and 126 shown in FIG. 4. Thus, the wearer need not remove belt 124 from pouch 122 when configuring bottom portion 70 from the configuration shown in FIG. 4 to that shown in FIG. 4*a*.

Referring to FIGS. 4 and 4*a*, bottom portion 70 further comprises a pair of complementary fly portions 140 and 142 that are secured together in an overlapping relationship when the bottom portion 70 is in a closed configuration (see FIG. 3) and are apart when the bottom portion 70 is in an opened position (see FIGS. 4 and 4*a*). Fly portion 140 comprises portion 144 of side 72 and strip 146 that is located on the same side as side 74 and directly opposite or behind portion 144 (see FIG. 4*a*). Strip 146 is configured to have a design or printed pattern that is the same as the design or pattern on side 14. Strip 146 is directly sewn to the rear side of portion 144 in a manner so as to form spaces (not shown, but similar to spaces 53 shown in FIG. 1*d*). Fly portion 140 includes buttons 148 attached to portion 144 and a plurality of button holes 150 formed in portion 144 wherein each button hole 150 is adjacent to a corresponding one of buttons 148. In one embodiment, each button hole 150 is generally horizontally oriented and positioned just below each corresponding button 148.

Referring to FIGS. 3 and 4*a*, fly portions 142 comprises portion 160 of side 72 and strip 162 that is located on the same side as side 74 and directly opposite portion 160. Strip 162 is configured to have a design or pattern that is the same as the design or pattern on side 14. Strip 162 is directly sewn to the rear side of portion 160 in a manner so as to form spaces (not shown, but similar to spaces 53 shown in FIG. 1*d*). Fly portion 160 includes buttons 164 attached to strip 162 and a plurality of button holes 166 formed in portion 160 wherein each button hole 166 is adjacent to a corresponding one of buttons 164. In one embodiment, each button hole 166 is generally horizontally oriented and positioned just below each corresponding button 164.

Referring to FIGS. 3 and 4, when bottom portion 70 is in the closed configuration and configured so that side 72 is the exterior side (shown in FIG. 3), each button 148 is disposed within a corresponding button hole 166 and positioned within the space between portion 160 and strip 162. Thus, buttons 148 do not contact the body of the wearer. When bottom portion 70 is in the closed configuration and is configured so that side 74 is the exterior side, each button 164 is disposed within a corresponding button hole 150 and positioned within the space (not shown) between portion 144 and strip 146. Thus, buttons 148 do not contact the body of the wearer.

With the exception of edge portions 50 and 60, pocket pouches 100 and 102, belt pouch 122 and fly portions 140 and 142, top and bottom portions 10 and 70, respectively, are fabricated from a single layer of material having a design or pattern on one side thereof that is the same as the design or pattern on side 12, and a second design or printed pattern on the opposite side of the single layer of material wherein the second design or pattern is the same as the design or pattern on side 14. However, this single layer of material or fabric is relatively thin and comfortable to wear. In an alternate embodiment, two different fabrics are used to fabricate the reversible garment of the present invention wherein one fabric a design or pattern that is the same as the design or pattern on side 12 and the other fabric has a design or pattern that is the same as the design or pattern on side 14.

Top and bottom portions 10 and 70, respectively, can be fabricated from a variety of materials or fabrics having a variety of textures and colors. The designs or printed patterns shown on sides 12 and 14 can be any design or pattern utilizing any colors. For military purposes, the designs or patterns shown on sides 12 and 14 can be camouflage designs. However, it is to be understood that other designs, colors or patterns can be used. Additionally, although the foregoing description is in terms of top portion 10 and bottom portion 70 being assembled via sewing and stitching, it is to be understood that other methods may be used to assemble the garment of the present invention, e.g. adhesives. Furthermore, other methods and devices may be used to removably secure front edge portions 50 and 60 together and removably secure of fly portions 140 and 142 together, such as Velcro™, hook fasteners, zippers, etc.

Significant advantages of the reversible garment of the present invention are:

a) top portion 10 and bottom portion 70 can be quickly and easily reversed to either the first configuration, wherein sides 12 and 72 define the exterior sides of the garment, or to the second configuration, wherein sides 14 and 74 define the exterior sides of the garment;

b) the reversible pocket portions 100 and 102 can be quickly inserted through pocket slots 104 and 106, respectively; and c) belt 124 is easily accessible regardless of whether bottom portion 70 has the first configuration shown in FIG. 4 or the second configuration shown in FIG. 4*a*.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, having described the invention, what is claimed is:

1. An outfit, comprising:

a top portion for covering at least the upper torso and shoulder area of the body of a wearer, the top portion having an interior side confronting the wearer and an exterior side opposite the interior side, the top portion having a first side configured to have a first design and a second side opposite the first side and configured to have a second design, the top portion being reversible to a first configuration wherein the first side defines the exterior side and the second side defines the interior side and to a second configuration wherein the second side defines the exterior side and the first side defines the interior side; and a bottom portion for covering at least the waist portion and at least a portion of the upper thighs of the wearer, the bottom portion having an interior side confronting the wearer and an exterior side opposite the interior side, the bottom portion further including a waist portion, a first side that is configured to have the first design and a second side that is opposite the first side and is configured to have the second design, the bottom portion being reversible to either a first configuration wherein the first side of the bottom portion defines the exterior side of the bottom portion and the second side of the bottom portion defines the interior side of the bottom portion and to a second configuration wherein the first side of the bottom portion defines the interior side of the bottom portion and the second side of the bottom portion defines the exterior side of the bottom portion, the bottom portion further including at least one pocket portion movably attached to the bottom portion and a corresponding pocket slot adjacent to and sized so as to allow the pocket portion to pass therethrough, the pocket portion having a first pouch and a second pouch, the first pouch having an exterior side configured with the first design, the second pouch having an exterior side configured with the second design;

whereby when the wearer desires to wear the garment so that the first design is visible and the second design faces the body of the wearer, the wearer configures the top and bottom portions to the first configuration and inserts the pocket portion through the pocket slot so that the exterior side of the first pouch is visible and the exterior side of the second pouch faces the wearer's body and when the wearer desires to wear the garment so that the second design is visible and the first design faces the wearer's body, the wearer configures the top and bottom portions to the second configuration and inserts the pocket portion through the pocket slot so that the exterior side of the second pouch is visible and the exterior side of the first pouch faces the wearer's body; and wherein the bottom portion includes a belt-receiving pouch that is located on the second side of the bottom portion and that extends about the waist portion, the belt-receiving pouch being sized for receiving a belt having a pair of ends, the belt-receiving pouch having a pair of openings that are formed therein and which are located on the second side of the bottom portion so as to allow ends of a belt to extend from the openings when a belt is disposed within the belt-receiving pouch, the waist portion further including a pair of slots formed therein, each slot being sized to allow a corresponding end of a belt to pass therethrough.

2. The outfit according to claim 1 further comprising:

a belt disposed within the belt-receiving pouch, the belt having a pair of ends; and a belt fastening device having a pair of complementary fastening portions, each fastening portion being attached to a corresponding end of the belt, each slot being sized to allow a corresponding fastening portions to pass therethrough;

whereby the wearer passes each end of the belt through a corresponding slot so that the ends of the belt are on the first side of the bottom portion when the wearer configures the bottom portion in first configuration, and withdraws the ends of the belt from the slots so that the ends of the belt are on the second side of the bottom portion when the wearer configures the bottom portion in the second configuration.

3. The outfit according to claim 1 wherein the bottom portion further comprises:

first and second fly portions that are configured to be removably secured together in an overlapping relationship when the bottom portion is in a closed configuration, the first fly portion comprising a first portion of the first side of the bottom portion and a first fly strip located on the same side as the second side of the bottom portion and directly opposite the first portion, the first fly strip being configured to have the second design, the second fly portion comprising a second portion of the first side of the bottom portion and a second fly strip located on the same side as the second side of the bottom portion and directly opposite the second portion of the first side, the second fly strip being configured to have the second design, wherein both the first fly strip and the second fly strip have the second design thereon; and means for removably securing the first and second fly portions together when the bottom portion is in either the first or second configuration.

4. The outfit according to claim 3 wherein the removably securing means comprises:

a plurality of buttons attached to the first portion of the first side of the bottom portion;

a plurality of button holes formed in the first portion of the first side of the bottom portion wherein each button hole is adjacent to a corresponding button;

a plurality of buttons attached to the second fly strip; and a plurality of button holes formed in the second fly strip wherein each button hole in the second fly strip is adjacent to a corresponding button of the second fly strip;

wherein the buttons of the first portion of the first side of the bottom portion are disposed within the button holes of the second fly strip when the bottom portion is closed and in the first configuration and wherein the buttons of the second fly strip are disposed in the button holes of the first portion of the first side of the bottom portion when the bottom portion is closed and in the second configuration.

5. The outfit according to claim 1 wherein the top portion further comprises first and second front edge portions that are removably secured together in an overlapping relationship when the top portion is in a closed configuration and are apart when the top portion is in an opened position.

6. The outfit according to claim 5 wherein the first edge portion comprises a first portion of the first side and a first strip located on the second side of the top portion and directly opposite the first portion, the first strip configured to have the second design, the second edge portion comprises a second portion of the first side and a second strip located on the second side of the top portion and directly opposite the second portion, the second strip being configured to have the second design, the top portion further comprising to means to removably secure the first and second edges together so that the second strip covers the first portion when the top portion is in the first configuration and removably secure the first and second edges together so that the first portion covers the second strip when the top portion is in the second configuration, and wherein both the first strip and the second strip have the second design thereon.

7. An outfit comprising:

a top portion for covering at least the upper torso and shoulder area of a wearer, the top portion having an interior side confronting the wearer and an exterior side opposite the interior side, the top portion having a first side configured to have a first design and a second side opposite the first side and configured to have a second design, the top portion being reversible to a first configuration wherein the first side defines the exterior side and the second side defines the interior side and to a second configuration wherein the second side defines the exterior side and the first side defines the interior side; and a bottom portion for covering at least the waist portion and a portion of the thighs of a wearer's body, the bottom portion having an interior side confronting the wearer's body and an exterior side opposite the interior side, the bottom portion further including a waist portion, a first side that is configured to have the first design and a second side that is opposite the first side and is configured to have the second design, the bottom portion being reversible to either a first configuration wherein the first side of the bottom portion defines the exterior side of the bottom portion and the second side of the bottom portion defines the interior side of the bottom portion, and to a second configuration wherein the first side of the bottom portion defines the interior side of the bottom portion and the second side of the bottom portion defines the exterior side of the bottom portion, the bottom portion further including a belt-receiving pouch located on the second side of the bottom portion and extending about the waist portion, the belt-receiving pouch being sized for receiving a belt having a pair of ends, the belt-receiving pouch having a pair of openings located on the second side of the bottom portion to allow the ends of a belt to extend from the pouch when a belt is disposed within the belt-receiving pouch, the waist portion further including a pair of slots formed therein, each slot being sized to allow the ends of a belt to pass therethrough.

8. The outfit according to claim 7 further comprising:

a belt disposed within the pouch, the belt having a pair of ends; and a fastening device attached to the belt, the device comprising a pair of complementary fastening portions, each fastening portion being attached to a corresponding end of the belt, each slot being sized for allowing a fastening portion to pass therethrough, whereby the wearer passes the ends of the belt through the slots so that the ends of the belt are on the first side of the bottom portion when the wearer configures the bottom portion to the first configuration, and withdraws the ends of the belts from the slots so that the ends of a belt are on the second side of the bottom portion when the wearer configures the bottom portion to the second configuration.

9. The outfit according to claim 7 wherein the bottom portion further includes at least one pocket portion movably attached to the bottom portion and a corresponding pocket slot adjacent to the pocket portion, the pocket slot being sized so as to allow the pocket pouch to pass therethrough, the pocket portion having a first pouch and a second pouch, the first pouch having an exterior side configured with the first design, the second pouch having an exterior side configured with the second design, whereby when the wearer desires to configure the top and bottom portions to the first configuration, the wearer inserts the pocket portion through the pocket slot so that the exterior side of the first pouch is visible and the exterior side of the second pouch faces the wearer's body and when the wearer desires to configure the top and bottom portions to the second configuration, the wearer inserts the pocket portion through the pocket slot so that the exterior side of the second pouch is visible and the exterior side of the first pouch faces the wearer's body.

10. The outfit according to claim 7 wherein the bottom portion further comprises:

first and second fly portions that are configured to be removably secured together in an overlapping relationship when the bottom portion is in a closed configuration, the first fly portion comprising a first portion of the first side of the bottom portion and a first fly strip located on the same side as the second side of the bottom portion and directly opposite the first portion, the first fly strip configured to have the second design, the second fly portion comprising a second portion of the first side of the bottom portion and a second fly strip located on the same side as the second side of the bottom portion and directly opposite the first portion, the second fly strip configured to have the second design; and means for removably securing the first and second fly portions together when the bottom portion is in either the first or second configuration.

11. An outfit for covering at least a waist portion and a portion of the thighs of the wearer's body, the garment having an interior side for confronting the wearer's body and an exterior side opposite the interior side, the garment further including a waist portion, a first side that is configured to have a first design and a second side that is opposite the first side and is configured to have a second design, the garment being reversible to either a first configuration wherein the first side defines the exterior side and the second side defines the interior side and to a second configuration wherein the first side defines the interior side and the second side defines the exterior side, the garment including a pouch located on the second side and which extends about the waist portion, the pouch being sized for receiving a belt having a pair of ends, the pouch having a pair of openings formed therein and located on the second side of the garment so as to allow the ends of a belt to extend therefrom when a belt is disposed within the pouch, the waist portion further including a pair slots formed therein wherein each slot is sized so as to allow a corresponding end of a belt to pass therethrough.

12. The outfit according to claim 11 further comprising:

a belt disposed within the pouch, the belt having a pair of ends; and a fastening device attached to the belt, the device comprising a pair of complementary fastening portions, each fastening portion being attached to a corresponding end of the belt, each slot being sized for allowing a fastening portion to pass therethrough, whereby the wearer passes the ends of the belt through the slots so that the ends of the belt are on the first side of the bottom portion when the wearer configures the bottom portion in first configuration, and withdraws the ends of the belts from the slots so that the ends of a belt are on the second side of the bottom portion when the wearer configures the bottom portion in the second configuration.

13. The outfit according to claim 11 wherein the bottom portion further comprises:

first and second fly portions that are configured to be removably secured together in an overlapping relationship when the bottom portion is in a closed configuration, the first fly portion comprising a first portion of the first side of the bottom portion and a first fly strip located on the same side as the second side of the bottom portion and directly opposite the first portion, the first fly strip configured to have the second design, the second fly portion comprising a second portion of the first side of the bottom portion and a second fly strip located on the same side as the second side of the bottom portion and directly opposite the first portion, the second fly strip configured to have the second design; and means for removably securing the first and second fly portions together when the bottom portion is in either the first or second configuration.

* * * * *